United States Patent [19]

McCrory et al.

[11] 4,251,893

[45] Feb. 24, 1981

[54] INFLATABLE BOAT FOR HIGH SPEED USE

[75] Inventors: William W. McCrory; Joseph D. Ramirez; David R. Bon; Bruce Dzadek, all of Panama City; William B. Quigley, Panama City Beach, all of Fla.

[73] Assignee: The United States of America as represented by the Secretary of the Navy, Washington, D.C.

[21] Appl. No.: 65,489

[22] Filed: Aug. 10, 1979

[51] Int. Cl.[3] ..... B63C 9/04

[52] U.S. Cl. ..... 9/11 A

[58] Field of Search ..... 9/2 R, 2 A, 2 F, 11 R, 9/11 A, 310 F

[56] References Cited

U.S. PATENT DOCUMENTS 2,508,304 5/1950 Sturtevant ..... 9/2 A

FOREIGN PATENT DOCUMENTS 681404 1/1965 Italy ..... 9/11 A

*Primary Examiner*—Trygve M. Blix
*Assistant Examiner*—Jesus D. Sotelo
*Attorney, Agent, or Firm*—Richard S. Sciascia; Harvey A. David

[57] ABSTRACT

An inflatable boat having tubular side and bow forming sponsons spanned by a hull bottom or floor structure including an upper inflatable floor superimposed on a lower inflatable floor, in combination with a rigid sectional keelson that is removably secured at a plurality of locations to each of the floors. Top and bottom walls of the inflatable floors are interconnected by drop stitches to limit distension to a uniform spacing when inflated.

7 Claims, 5 Drawing Figures

INFLATABLE BOAT FOR HIGH SPEED USE

BACKGROUND OF THE INVENTION

This invention relates to inflatable boats, and more particularly to such craft capable of being driven at high speeds by an engine such as an outboard motor.

A wide variety of collapsible and inflatable boats have been known for their virtues of compact storage when not in use, lightness in weight, and large measure of buoyancy. Those virtues have made such craft suitable for use as life boats, work boats that can be carried to places of use under circumstances that would be difficult to transport rigid boats, and for a variety of recreational uses.

One of the limitations characteristic of inflatable boats has been that the powering thereof by outboard motors of sufficient size to achieve planning speeds has met with only limited success. This is generally due to the inherently flexible nature of the craft, and particularly of the bottom or floor thereof which has a tendency to conform to the shape of the wave generated by the hull during movement through the water.

It is generally the current practice to stabilize the flexible bottom or floor of inflatable boats that are to be motor driven by installing a rigid backing therefor in the form of a plywood floorboard, either in one panel or formed of a plurality of sections in the interest of compact storage and ease of handling. While such floorboard reinforcement of the flexible bottom or floor provides good performance in use, the board or board sections are still not suitable for certain applications or uses of inflatable boats. In particular, where the inflatable boat must be dropped from an aircraft as a package in its deflated and furled condition, it has been found that the floorboard sections do not survive the impact of the package with water well enough for reliable use. This has been found to be true for sections formed of fiberglass reinforced plastic as well as for those formed of plywood.

In addition, even the use of sectional floorboard panels results in a storage package, when the boat is collapsed and furled, that is too large for certain situations, for example where it is necessary to pass the package out of a submarine through an escape hatch.

Other constructions have been proposed in an effort to render the fabric bottom or floor of an inflatable or folding boat sufficiently rigid for use of the boat with an outboard motor at relatively high speeds. These have included variations of inflatable keelsons or rigid frames formed of pipe. So far as has been determinable by applicants none of the prior constructions meet the required degree of rigidity in use, compactness of packaging for transport or storage, survivability of impact, or load and propulsion carrying capabilities that are desired for certain military applications.

SUMMARY OF THE INVENTION

With the foregoing in mind, it is a principal object of this invention to provide an improved inflatable boat that will overcome the shortcomings of the prior art for use in certain conditions.

Another object of this invention is to provide a particularly rugged inflatable boat of the type generally known as "rubber boats," and which is characterized by the ability to be collapsed and furled into a small package, and is capable of being driven at high speeds by an outboard motor while carrying heavy loads.

Yet another object is the provision of an inflatable boat of the foregoing character that is resistant to damage from impact of aerial drop when in its packaged condition.

Still another object is the provision of an inflatable boat that can be readily unfurled, inflated, and components assembled without tools, and in the dark, if need be.

The invention may be further said to reside in certain novel constructions, combinations, and arrangements of parts by which the foregoing objects and advantages are achieved, together with other objects and advantages which will become apparent from the following description of a presently preferred embodiment when read in conjunction with the accompanying sheets of drawings.

DESCRIPTION OF THE PREFERRED EMBODIMENT

Figure 1:
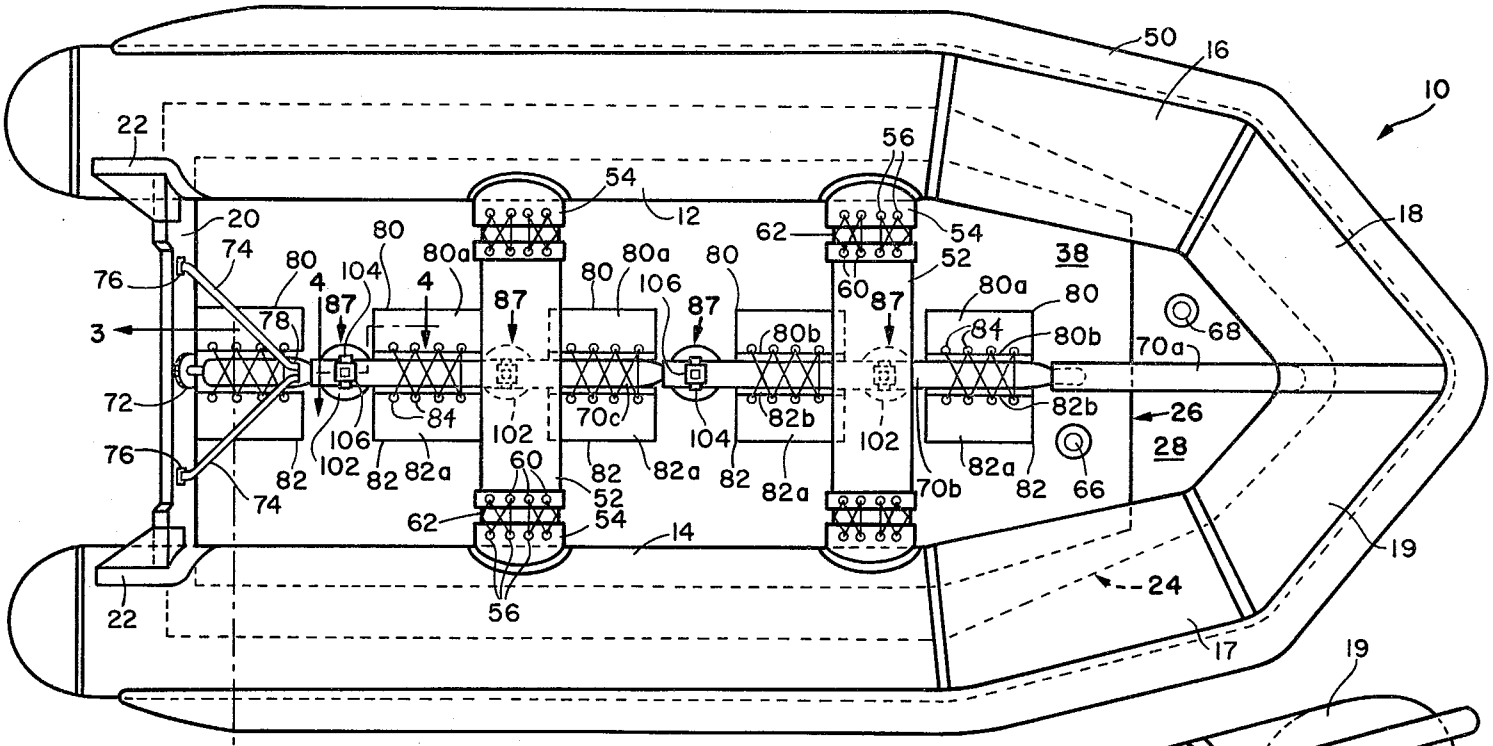
FIG. 1 is a plan view of an inflatable boat embodying the invention.

In the form of the invention illustrated in the drawings and described hereinafter, there is provided an inflatable boat 10, the hull of which comprises inflatable tubular fabric sponson means including a pair of laterally spaced, parallel, side sponson sections 12 and 14. The tubular side sections 12 and 14 are interconnected by angularly disposed inflatable sections 16, 17, 18 and 19 to form a generally pointed bow of the hull. The side sections 12 and 14 are also interconnected, between the stern portions thereof, by a transom member 20, conveniently formed of wood and fixed to the side sponson sections by appropriately bonded fillets 22 of fabric. The fabric, of which various parts of the hull such as sponson sections, fillets, reinforcements, hull bottom, thwarts, and the like are formed, can comprise any of a number of air impervious, flexible and stretch resistant materials that are well known in the art to which the invention pertains. Among these are combinations of nylon, glass, or aramid fiber, layered with or impregnated by synthetic rubber or plastic. While the fabric is shown as of a single thickness for clarity, it will be understood that it may comprise multiple layers.

The hull bottom or floor, in accordance with this invention, is formed of two superimposed, inflatable floor layers. Thus, a lower inflatable floor layer is indicated generally at 24 while an upper inflatable floor layer is indicated generally at 26. The lower floor layer 24 comprises spaced top and bottom fabric walls 28, 30 that are interconnected by a multiplicity of flexible threads 32, conveniently formed in rows as drop-stitches of uniform length, and which serve as tension members to limit the spacing between the top and bottom walls when air is contained therebetween at a pressure above atmospheric pressure. Similarly, the upper inflatable layer 26 comprises spaced top and bottom fabric walls 38, 40 that are interconnected by a multiplicity of rows of flexible threads 42 which serve as tension members to limit the space between those top and bottom walls, while permitting substantially unrestricted flow of air between the spaced walls.

When inflated to pressures on the order of 7 lbs. per square inch, each of the floor layers 24, 26, by virtue of their construction utilizing a large number of drop-stitch tension threads 32, 42, become quite rigid without distension beyond the desired uniform predetermined spacing allowed by the threads. At this point it should be noted that, in the interest of clarity of views, the drop-stitch threads 32, 42 are not shown in their full numbers or actual spacing, the threads being actually more numerous and closer together than shown.

The lower inflatable floor layer 24 of the hull bottom has its peripheral edges bonded to the sponson means by suitable fabric fillets 44, while the upper inflatable floor layer 26 has its peripheral edges bonded to the sponson means by suitable fabric fillets 46. The top wall 28 of the lower inflatable layer 24 and the bottom wall 40 of the upper inflatable layer 26 are preferably bonded or cemented together into a unitary hull bottom structure.

An inflatable fabric rub or spray rail 50 is preferably provided around the perimeter of the sponson means, and serves both as a rub rail to prevent scuffing of the sponson means against rought or sharp surfaces such as may be presented by piers, ship hulls or the like, and as a spary rail to deflect spray when the boat 10 is driven at planning speeds.

Extending transversely between the parallel, sponson side sections 12 and 14 are a pair of inflatable cylindrical thwarts 52, the opposite ends of which are received in fabric sockets 54 bonded to the sponson side sections and carrying a plurality of hooks 56. The thwarts 52 are provided, near the ends thereof, with annular cuffs 58, each carrying a series of hooks 60. Laces 62 cooperate with the hooks 56, 60 to provide a rapid, convenient, and reliable means for manually securing the thwarts in place.

It will be understood that the various inflatable components of the hull 10, that is the sponson means, the inflatable bottom or floor layers 24, 26, the spray rail 50, and the thwarts 52, are provided with valves for use in inflating those components either from pressurized flasks or by pumps. Two of the valves are indicated at 66 and 68, serving the upper and lower floor layers 24 and 26, respectively. Such valves and inflating means are well known in the art and need not be further described herein.

Figure 2:
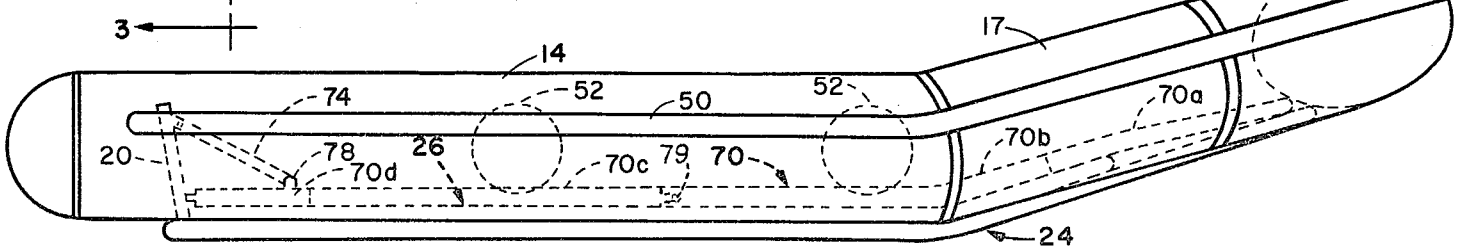
FIG. 2 is a side elevational view of the boat of FIG. 1.
Figure 3:
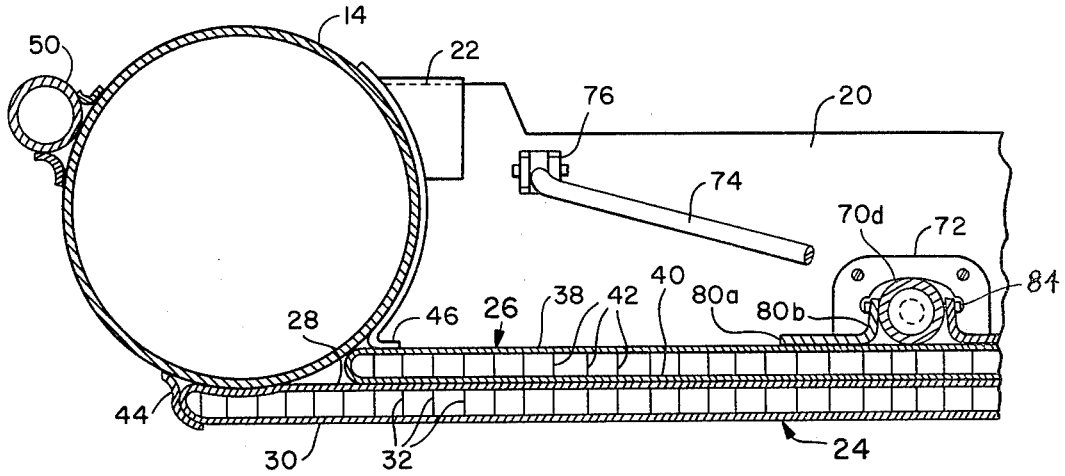
FIG. 3 is a fragmentary sectional view, taken substantially along line 3—3 of FIG. 1 and on a slightly enlarged scale.

In accordance with this invention the boat 10 further comprises, in combination with the double inflatable bottom or floor layers 24, 26, a rigid, tubular metal keelson, indicated generally at 70. The keelson 70 is formed of a plurality of segments 70*a*, 70*b*, 70*c*, 70*d*, and 70*e* having telescoping end portions. The sternmost section 70*e* is provided with a reduced end adapted to be received in a socket 72 fixed to the lower, inside surface of the transom 20. A pair of struts 74 have aft ends releasably connected by laterally spaced fittings 76 on the transom, and extend forward therefrom in converging relation for connection to a fitting 78 forward of the transom on the keelson section 70*e*. The sections 70*a* and 70*b* of the keelson are bent somewhat, as is best shown in FIG. 2, to conform to the upwardly inclined bow of the boat and sections 70*b* and 70*c* are preferably keyed together as at 79 to prevent rotation of the forward sections.

The keelson 70 lies upon the top wall 38 of the upper inflatable floor layer 26 and is secured thereto along a plurality of spaced locations. To this end, a plurality of rectangular fabric panels 80, 82 are arranged in pairs along the centerline of the hull, with substantially the outboard one-half 80*a*, 82*a* of each panel being bonded, as by a suitable cement, to the upper surface of the wall 38, and the other half 80*b*, 82*b* of each panel being turned upwardly alongside the keelson 70. The panel halves 80*b*, 82*b* are each provided with a row of hooks 84, best shown in FIG. 4, which cooperate with laces 86 reeved back and forth across the keelson.

Figure 4:
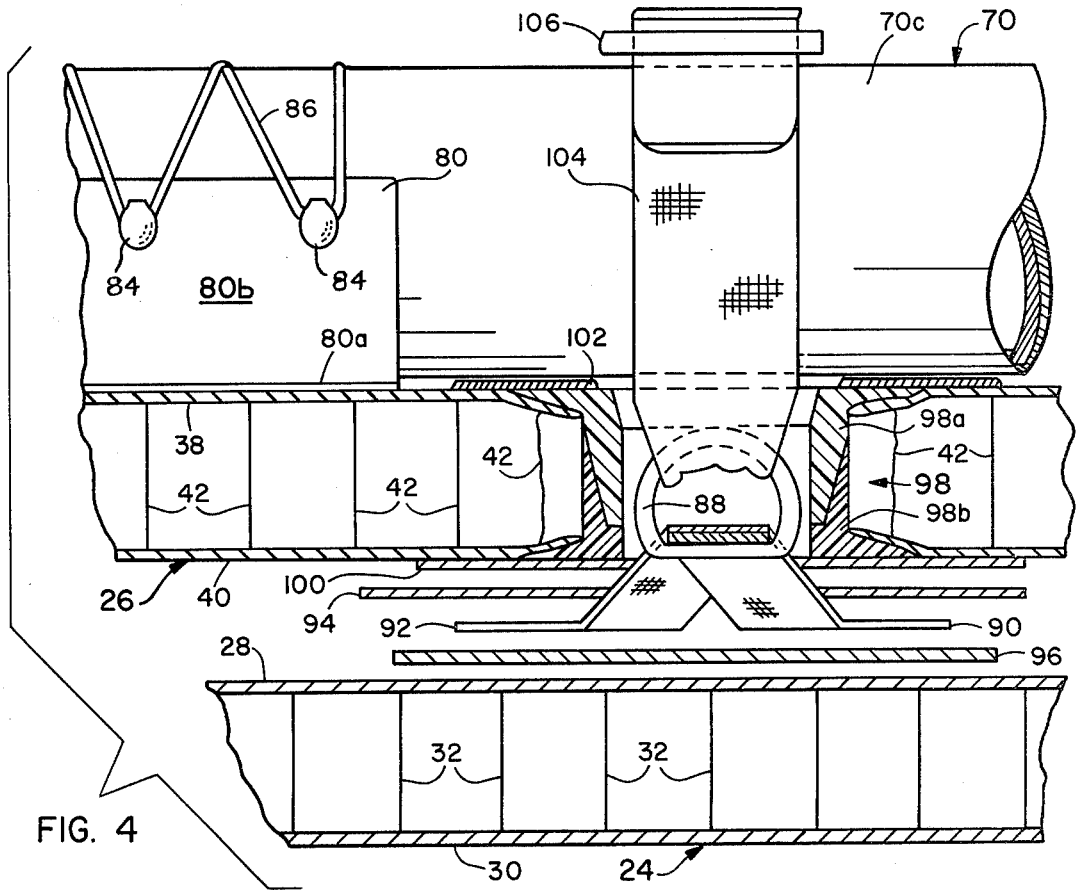
FIG. 4 is a fragmentary sectional view taken substantially along line 4—4 of FIG. 1 and on a still larger scale than FIG. 3.

The keelson 70 is further secured at a plurality of spaced locations 87 therealong to the upper wall 28 of the lower inflatable floor layer 24. Referring to FIG. 4, illustrating one of those locations 87, a D-ring 88 is positioned on a pair of crossed fabric strips 90, 92, the outwardly directed end portions of which are bonded between a fabric ring or annulus 94 and a fabric reinforcement patch 96. The D-ring 88 is extended upwardly into a large plastic or synthetic rubber grommet or flanged bushing 98 bonded in openings in the upper and lower walls of the upper inflatable floor layer 26. The bushing 98 is conveniently formed of two nested parts 98*a*, 98*b* assembled from opposite sides of the upper floor layer and bonded to one another. Annular fabric patches 100, 102 are bonded by suitable cement to the flanges of the bushing 98 and the surrounding surfaces of the walls 38 and 40. When the inflatable floor layers 24 and 26 are assembled, they are bonded together with suitable cement with the straps 90, 92, and the fabric elements 94, 96, and 100 sandwiched therebetween.

A flexible strap 104, having a buckle 106, is passed through the D-ring 88 and around the keelson 70 at each of the other locations of similar construction. The buckles 106 permit rapid cinching of the keelson 70 into place where it is held during the securing of the laces 86. Moreover, in the event the upper floor layer 26 becomes deflated for any reason, the slack may be readily taken up by the straps 104 and buckles 106 so that operation of the boat can be maintained at planning speeds. In the event the lower floor layer 24 becomes deflated, the inflated upper layer 26, in combination with the keelson 70, provides a sufficiently rigid backing for the lower floor layer to permit continued high speed operation.

Figure 5:
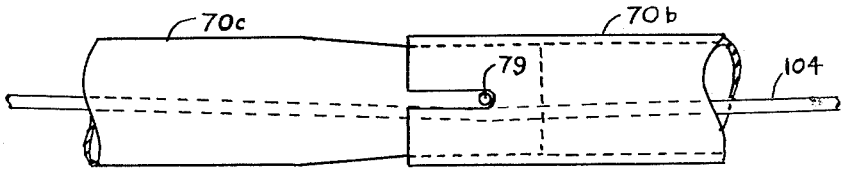
FIG. 5 is a fragmentary view illustrating a portion of the keelson of the boat.

The sectional, tubular keelson 70 advantageously comprises tether means in the form of an elastic cord 104, see FIG. 5, threaded through the lumens of the respective sections 70*a*–70*d* so as to prevent loss of any of those sections when the keelson is in a dismantled condition. In addition, the elastic cord maintains the unassembled sections in their proper order for ease in assembly.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A collapsible and inflatable boat comprising:

inflatable sponson means comprising laterally spaced, elongated tubular side sections, connected at their forward ends by tubular bow sections;

rigid transom means extending transversely between adjacent aft end portions of said tubular side sections;

floor means spanning said sponson means and comprising upper and lower inflatable layers;

rigid elongated keelson means, extending between said transom means and said bow sections and lying on the upper surface of said upper inflatable layer;

first means for securing said keelson means at a first plurality of locations along the length thereof to said upper surface of said upper inflatable layer; and second means for securing said keelson means at a second plurality of locations along the length thereof to the upper surface of said lower inflatable layer.

2. A collapsible and inflatable boat as defined in claim 1, and wherein said upper and lower inflatable layers of said floor means each comprise:

a top and a bottom wall of flexible, fluid impervious fabric; a multiplicity of flexible tension elements interconnecting said top and bottom walls so as to limit movement of said walls away from one another and provide a predetermined, substantially uniform space therebetween when inflated to pressures above atmospheric.

3. A collapsible and inflatable boat as defined in claim 2, and wherein said first means for securing said keelson means comprises:

a plurality of fabric panels disposed at said first plurality of locations, said panels having portions bonded to said top wall of said upper inflatable layer and other portions adapted to lie vertically alongside said keelson means; and lace means reeved over said keelson means between said other panel portions.

4. A collapsible and inflatable boat as defined in claim 3, and wherein said second means for securing said keelson means comprises:

a plurality of strap elements disposed at said second plurality of locations and connected to said top wall of said lower inflatable layer of said floor means;

said upper inflatable layer comprising means defining a plurality of openings therethrough in registration with said strap elements; and said strap elements extending through said openings and over said keelson means.

5. A collapsible and inflatable boat as defined in claim 4, and wherein said rigid elongated keelson means comprises:

a plurality of tubular metal sections coupled together substantially in end-to-end relation and adapted to be uncoupled for collapsing of said boat; and tether means, extending through said tubular sections, for maintaining said sections in a predetermined order for reassembly.

6. A collapsible and inflatable boat as defined in claim 5, and further comprising:

inflatable thwart means extending transversely between said tubular side sections, and removably secured thereto.

7. A collapsible and inflatable boat as defined in claim 6, and wherein said inflatable thwart means comprises:

a pair of fabric sockets, each fixed to one of said tubular side sections;

a substantially cylindrical inflatable thwart member having closed ends and a fabric cuff fixed adjacent each end thereof, said ends being received in said sockets; and lace means, cooperating with said sockets and cuffs, for releasably securing said thwart member between said tubular side sections.

* * * * *